US009407995B2

(12) United States Patent
Okamura et al.

(10) Patent No.: US 9,407,995 B2
(45) Date of Patent: Aug. 2, 2016

(54) ACOUSTIC GENERATOR, ACOUSTIC GENERATION DEVICE, AND ELECTRONIC DEVICE

(71) Applicant: KYOCERA Corporation, Kyoto-shi, Kyoto (JP)

(72) Inventors: Takeshi Okamura, Aira (JP); Shigenobu Nakamura, Kirishima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 14/402,807

(22) PCT Filed: Jun. 28, 2013

(86) PCT No.: PCT/JP2013/067892
§ 371 (c)(1),
(2) Date: Nov. 21, 2014

(87) PCT Pub. No.: WO2014/034250
PCT Pub. Date: Mar. 6, 2014

(65) Prior Publication Data

US 2015/0139456 A1 May 21, 2015

(30) Foreign Application Priority Data

Aug. 30, 2012 (JP) ..... 2012-190139

(51) Int. Cl.
*H04R 25/00* (2006.01)
*H04R 17/00* (2006.01)
*H04R 1/28* (2006.01)

(52) U.S. Cl.
CPC ..... *H04R 17/00* (2013.01); *H04R 1/2896* (2013.01); *H04R 2499/11* (2013.01)

(58) Field of Classification Search
CPC ..... H04R 17/00; H04R 2499/11
USPC ..... 381/190, 173; 310/334, 342
See application file for complete search history.

(56) References Cited

U.S. PATENT DOCUMENTS

2013/0094681 A1* 4/2013 Fukuoka ..... H04R 17/00 381/190

FOREIGN PATENT DOCUMENTS

JP 2004-023436 A 1/2004
JP 2012-110018 A 6/2012

OTHER PUBLICATIONS

International Search Report, PCT/JP2013/067892, Aug. 22, 2013, 1 pg.

* cited by examiner

*Primary Examiner* — Sunita Joshi
(74) *Attorney, Agent, or Firm* — Volpe and Koenig, P.C.

(57) ABSTRACT

A purpose is to obtain a frequency characteristic of a good sound pressure. To achieve the purpose, an acoustic generator according to an embodiment includes a piezoelectric element (exciter), a flat vibrating body, and a resin layer. The piezoelectric element vibrates when an electric signal is input. To the vibrating body, the piezoelectric element is attached. The vibrating body vibrates with the piezoelectric element due to the vibration of the piezoelectric element. The resin layer is arranged to cover surfaces of the piezoelectric element and the vibrating body to which the piezoelectric element is attached. The resin layer is integrated with the vibrating body and the piezoelectric element. Also, to the resin layer, irregularity is provided.

6 Claims, 7 Drawing Sheets

ACOUSTIC GENERATOR, ACOUSTIC GENERATION DEVICE, AND ELECTRONIC DEVICE

CROSS-REFERENCE TO RELATED APPLICATIONS

This application is national stage application of International Application No. PCT/JP2013/067892, filed on Jun. 28, 2013, which designates the United States, incorporated herein by reference, and which claims the benefit of priority from Japanese Patent Application No. 2012-190139, filed on Aug. 30, 2012, the entire contents of which are incorporated herein by reference.

FIELD

An embodiment of the disclosure relates to an acoustic generator, an acoustic generation device, and an electronic device.

BACKGROUND

Conventionally, an acoustic generator using a piezoelectric element has been known (see, for example, Patent Literature 1). The acoustic generator vibrates a vibration plate by applying voltage to a piezoelectric element attached to the vibration plate and by vibrating the piezoelectric element. The acoustic generator outputs sound by actively using resonance of the vibration.

Also, in the acoustic generator, a thin film such as a resin film can be used as the vibration plate. Thus, the acoustic generator can be made thinner and lighter than a general electromagnetic speaker or the like.

Note that when a thin film is used as the vibration plate, in order to obtain good acoustic conversion efficiency, it is desired that the thin film is supported in such a manner that tension is uniformly applied thereto, for example, by being held between a pair of frame members in thickness direction.

CITATION LIST

Patent Literature

Patent Literature 1: Japanese Laid-open Patent Publication No. 2004-023436

SUMMARY

Technical Problem

However, since the above described conventional acoustic generator actively uses resonance of a vibration plate to which tension is uniformly applied, there has been a problem that a peak (part where sound pressure is higher than periphery thereof) and a dip (part where sound pressure is lower than periphery thereof) are easily generated in a frequency characteristic of a sound pressure and that it is difficult to obtain good sound quality.

Solution to Problem

An acoustic generator according to an aspect of an embodiment includes an exciter, a flat vibrating body, and a resin layer. The exciter configured to vibrate when an electric signal is input. The vibrating body to which the exciter is attached and which is configured to vibrate with the exciter due to the vibration of the exciter. The resin layer is arranged to cover surfaces of the exciter and the vibrating body to which the exciter is attached. The resin layer is integrated with the vibrating body and exciter. Also, on a surface of the resin layer, irregularity is provided.

DESCRIPTION OF EMBODIMENTS

In the following, with reference to the attached drawings, an embodiment of an acoustic generator, an acoustic generation device, and an electronic device disclosed in the present application will be described in detail. Note that this invention is not limited to the embodiment described in the following.

Figure 1A:
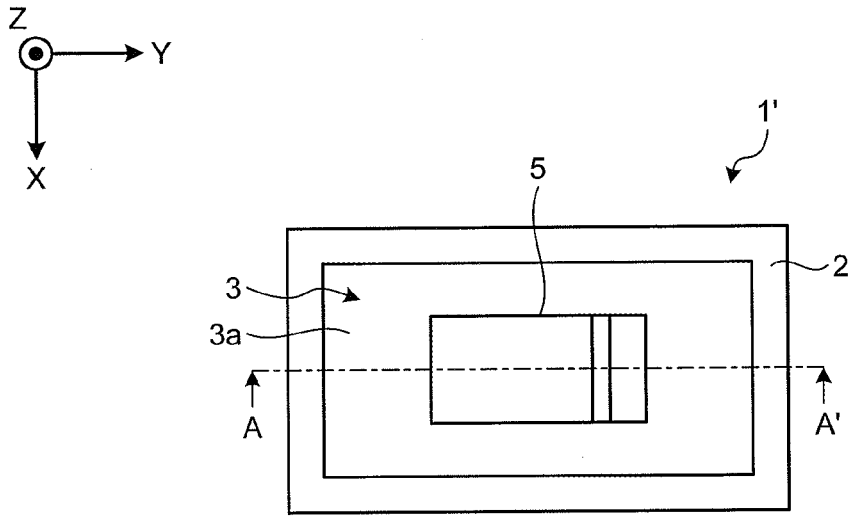
FIG. 1A is a schematic plane view illustrating a schematic configuration of a basic acoustic generator.

First, before description of an acoustic generator 1 according to the embodiment, a schematic configuration of a basic acoustic generator 1' will be described with reference to FIG. 1A and FIG. 1B. FIG. 1A is a schematic plane view illustrating a schematic configuration of the acoustic generator 1' and FIG. 1B is an A-A' sectional view of FIG. 1A.

Figure 1B:
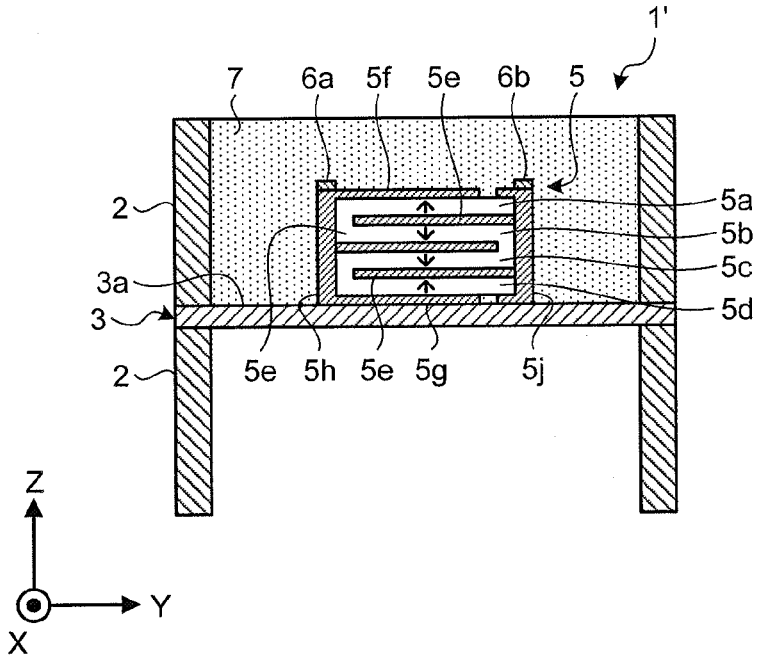
FIG. 1B is an A-A' sectional view of FIG. 1A.

Note that to make it easier to understand the description, in FIG. 1A and FIG. 1B, a three-dimensional orthogonal coordinate system including a Z-axis, an upward vertical direction thereof being a positive direction and a downward vertical direction thereof being a negative direction, is illustrated. The orthogonal coordinate system may be illustrated in a different drawing used for later description.

Also, in the following, in respect to a configuration element including a plurality of pieces, a reference sign may be assigned only to one of the pieces and the reference sign may be omitted for the rest. In such a case, it is assumed that the one to which the reference sign is assigned and the rest include similar configurations.

Also, in FIG. 1A, a resin layer 7 (described later) is not illustrated. Also, to make it easier to understand the description, in FIG. 1B, the acoustic generator 1' is exaggerated in thickness direction (Z-axis direction).

As illustrated in FIG. 1A, the acoustic generator 1' includes a frame body 2, a vibration plate 3, and a piezoelectric element 5. Note that as illustrated in FIG. 1A, in the following description, a case where one piezoelectric element 5 is included will be described as an example, but the number of the piezoelectric elements 5 is not limited thereto.

The frame body 2 includes two rectangular frame members having the same shape. The frame body 2 functions as a support member to sandwich a peripheral edge part of the vibration plate 3 and to support the vibration plate 3. The vibration plate 3 has a flat-shape such as a plate-like shape or a film-like shape. The peripheral edge part of the vibration plate 3 is sandwiched and fixed by the frame body 2 and the vibration plate 3 is supported flatly in such a manner that tension is uniformly applied thereto in a frame of the frame body 2.

Note that a part of the vibration plate 3, which part is inside an inner periphery of the frame body 2, that is, a part of the vibration plate 3 which is not sandwiched by the frame body 2 and which can vibrate freely, is assumed as a vibrating body 3*a*. That is, the vibrating body 3*a* is a substantially rectangular part in the frame of the frame body 2.

Also, the vibration plate 3 can be formed from various materials such as resin, metal, and the like. For example, the vibration plate 3 may include a resin film the thickness of which is 10 to 200 μm and which is made from polyethylene, polyimide or the like.

Also, the thickness, a material, and the like of the frame body 2 are not particularly limited. The frame body 2 can be formed by using various materials such as metal or resin. For example, a stainless film, the thickness of which is 100 to 1000 μm, can be suitably used as the frame body 2 because mechanical strength and corrosion resistance of stainless are excellent.

Note that in FIG. 1A, a shape of a region inside the frame body 2 is substantially rectangular but may be a polygon such as a parallelogram, a trapezoid, or a regular n-gon. In the present embodiment, as illustrated in FIG. 1A, it is assumed that a substantially rectangular shape is employed.

Also, in the above description, a case, where the frame body 2 includes the two frame members and the peripheral edge part of the vibration plate 3 is sandwiched and supported by the two frame members, has been described as an example, but is not a limitation. For example, the frame body 2 may include one frame member and the peripheral edge part of the vibration plate 3 may be supported by being attached and fixed to the frame body 2.

The piezoelectric element 5 is provided to a surface of the vibrating body 3*a*, for example, by being pasted. The piezoelectric element 5 is an exciter which excites the vibrating body 3*a* by vibrating when voltage is applied.

As illustrated in FIG. 1B, the piezoelectric element 5 includes, for example, a laminate, surface electrode layers 5*f* and 5*g*, and external electrodes 5*h* and 5*j*. In the laminate, piezoelectric layers 5*a*, 5*b*, 5*c*, and 5*d*, which include four ceramic layers, and three internal electrode layers 5*e* are alternately laminated. The surface electrode layers 5*f* and 5*g* are respectively formed on an upper surface and a lower surface of the laminate. The external electrodes 5*h* and 5*j* are formed on a side surface on which the internal electrode layers 5*e* are exposed. Also, to the external electrodes 5*h* and 5*j*, lead terminals 6*a* and 6*b* are connected.

Note that the piezoelectric element 5 is tabular, and principal surfaces on an upper surface side and a lower surface side thereof are a polygon such as a rectangle or a square. Also, as illustrated in arrows in FIG. 1B, the piezoelectric layers 5*a*, 5*b*, 5*c*, and 5*d* are polarized. That is, the polarization is performed in such a manner that directions of the polarization relative to a direction of an electric field applied at a certain moment are reversed in one side and the other side in the thickness direction (Z-axis direction).

Then, when voltage is applied to the piezoelectric element 5 through the lead terminals 6*a* and 6*b*, for example, at a certain moment, the piezoelectric layers 5*c* and 5*d* on a side attached to the vibrating body 3*a* shrink and the piezoelectric layers 5*a* and 5*b* on an upper surface side of the piezoelectric element 5 are deformed and extended. Thus, by applying an AC signal to the piezoelectric element 5, the piezoelectric element 5 vibrates in a flexural manner and flexural vibration can be applied to the vibrating body 3*a*.

Also, a principal surface of the piezoelectric element 5 is joined to a principal surface of the vibrating body 3*a* by an adhesive such as an epoxy resin.

Note that as a material to configure the piezoelectric layers 5*a*, 5*b*, 5*c* and 5*d*, piezoelectric ceramics, which has been used conventionally, such as lead zirconate titanate, a Bi-layered compound, or a lead-free piezoelectric material such as a tungsten bronze structure compound can be used.

Also, as a material of the internal electrode layers 5*e*, various metal materials can be used. For example, when a metal component including silver and palladium and a ceramic component included in the piezoelectric layers 5*a*, 5*b*, 5*c*, and 5*d* are included, a stress due to a thermal expansion difference between the piezoelectric layers 5*a*, 5*b*, 5*c* and 5*d* and the internal electrode layers 5*e* can be reduced. Thus, the piezoelectric element 5 free from poor lamination can be obtained.

Also, the lead terminals 6*a* and 6*b* can be formed by using various metal materials. For example, when flexible wiring in which metallic foil such as copper or aluminum is sandwiched by a resin film is used to configure the lead terminals 6*a* and 6*b*, the height of the piezoelectric element 5 can be reduced.

Also, as illustrated in FIG. 1B, the acoustic generator 1' further includes a resin layer 7 which is formed in the frame of the frame body 2 by being poured to cover the surfaces of the piezoelectric element 5 and the vibrating body 3*a*.

As the resin layer 7, for example, an acrylic resin, an epoxy resin, or the like can be used. The resin layer 7 is poured and cures. Thus, the resin layer 7 is integrated with the vibrating body 3*a* and the piezoelectric element 5 and configures one composite vibrating body with the vibrating body 3*a* and the piezoelectric element 5.

Note that by completely burying the piezoelectric element 5 into the resin layer 7, an adequate damping effect can be induced. Thus, a resonance phenomenon can be controlled and a peak or a dip in a frequency characteristic of a sound pressure can be controlled to be small.

Also, in FIG. 1B, as the piezoelectric element 5, a bimorph-type laminated piezoelectric element has been described as an example, but is not a limitation. For example, a unimorph-type in which an elastic piezoelectric element 5 is pasted on the vibrating body 3*a* may be used.

Incidentally, in FIG. 1B, the vibrating body 3*a* flatly supported in the frame of the frame body 2 in such a manner that tension is uniformly applied thereto, the piezoelectric element 5 provided to the surface of the vibrating body 3*a*, and the resin layer 7 which is formed integrally with the two and a surface of which is rubbed and cut flatly at the height of the frame body 2 are illustrated.

That is, it can be said that the composite vibrating body including the vibrating body 3*a*, the piezoelectric element 5, and the resin layer 7 has a shape which is shaped as a whole and has a symmetric property, as it were. In such a case, a peak, a dip, or a deformation due to resonance induced by vibration of the piezoelectric element 5 is generated. Thus, in a certain frequency, a sound pressure is changed drastically and it is difficult to make a frequency characteristic of a sound pressure flat.

Figure 2:
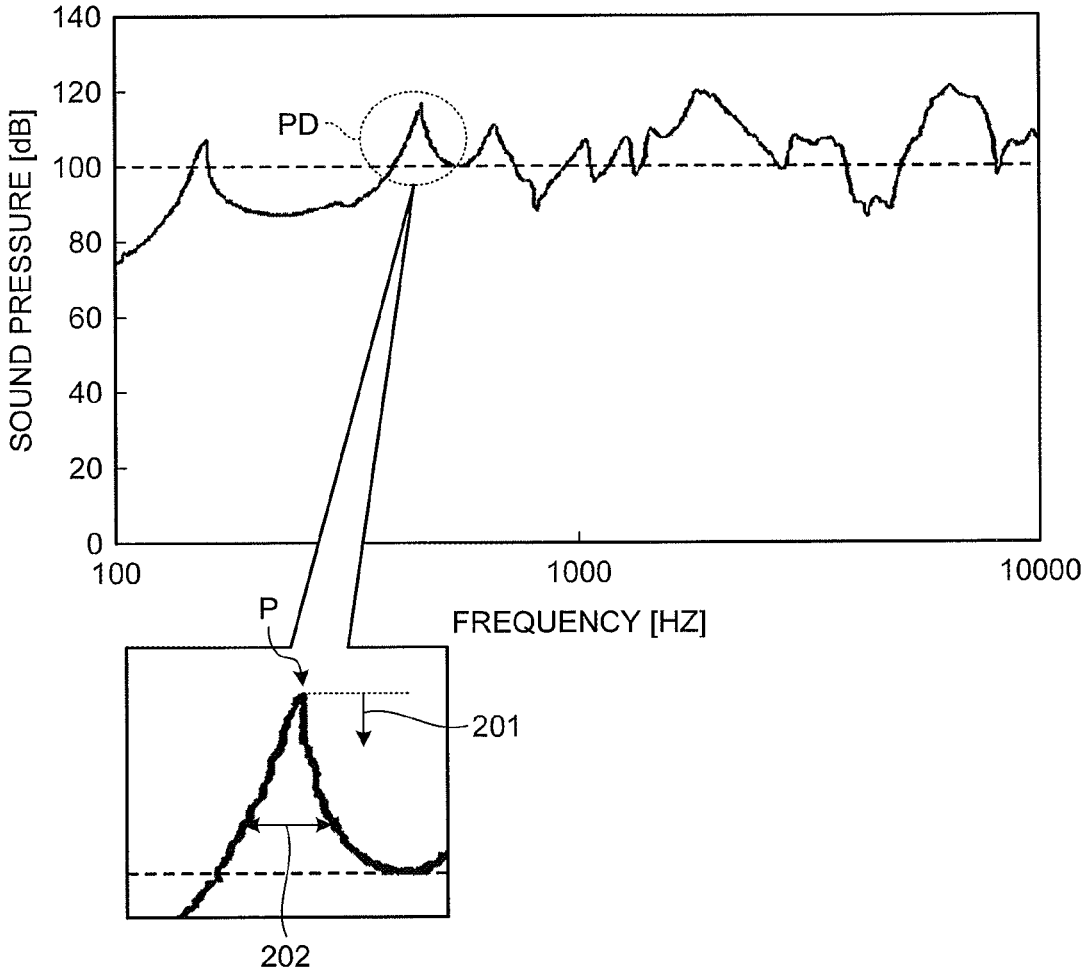
FIG. 2 is a view illustrating an example of a frequency characteristic of a sound pressure.

Such a point will be described in detail with reference to FIG. 2. FIG. 2 is a view illustrating an example of a frequency characteristic of a sound pressure. As described, when the composite vibrating body including the vibrating body 3*a*, the piezoelectric element 5, and the resin layer 7 as a whole has a symmetric property in a thickness direction, for example, the Young's modulus of the vibrating body 3*a* and the resin layer 7 as a whole becomes equal.

However, in such a case, a peak concentrates on a certain frequency and degenerates due to the resonance of the vibrating body 3*a*. Thus, as illustrated in FIG. 2, a steep peak or dip is easily generated in a scattered manner in a whole frequency domain.

As an example, a part illustrated by being surrounded by a dashed closed curve PD in FIG. 2 will be focused on. When such a peak P is generated, variation is generated in a sound pressure depending on a frequency, it becomes difficult to obtain a good sound quality.

In such a case, as illustrated in FIG. 2, it is effective to reduce the height of the peak P (see arrow 201 in drawing) and to increase a peak width (see arrow 202 in drawing) to make the peak P or a dip (not illustrated) small.

Thus, in the present embodiment, a surface of the resin layer 7 is made non-flat daringly. In other words, irregularity is provided on the surface of the resin layer 7 daringly. That is, a symmetric property of the above described composite vibrating body in the thickness direction is reduced and a resonance frequency is made partially uneven. Accordingly, the degeneracy of a resonance mode is released and scattering is performed to reduce the height of the peak P and to increase the peak width.

In the following, the acoustic generator 1 according to the embodiment will be described in detail serially with reference to FIG. 3A to FIG. 6. First, FIG. 3A is a schematic sectional view illustrating a configuration of the acoustic generator 1 according to the embodiment.

Note that in the following, including FIG. 3A, a schematic sectional view may be illustrated. Each schematic sectional view is a schematic sectional view of FIG. 1A cut in an A-A' line. Also, FIG. 3B is a schematic enlarged view of M1 illustrated in FIG. 3A. Also, FIG. 3C is a schematic plane view illustrating a distribution region of a protrusion part and a recessed part.

Figure 3A:
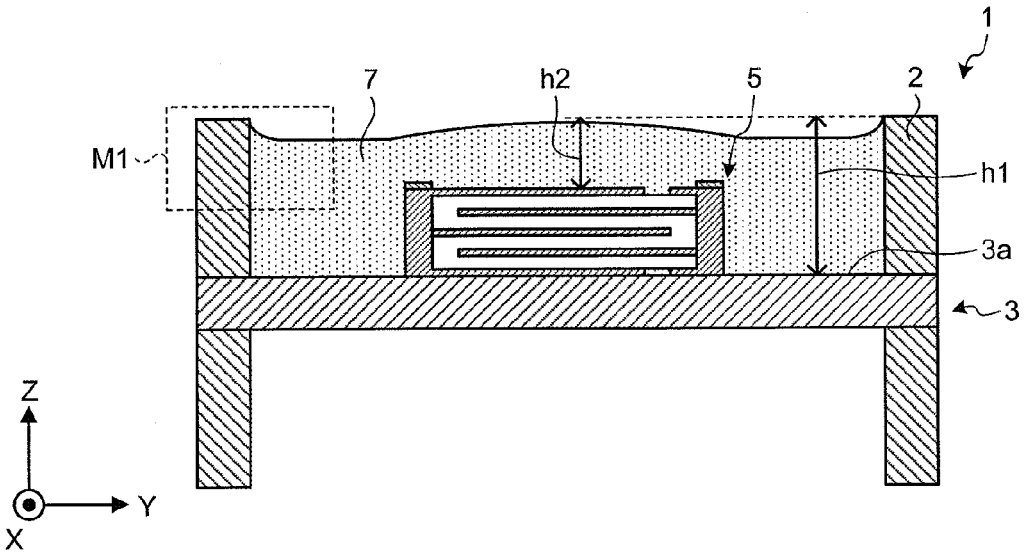
FIG. 3A is a schematic sectional view illustrating a configuration of an acoustic generator according to an embodiment.
Figure 3B:
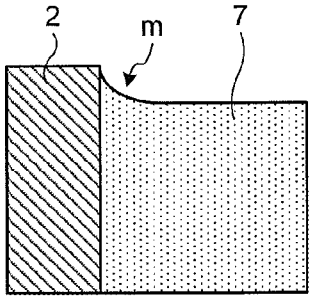
FIG. 3B is a schematic enlarged view of M1 illustrated in FIG. 3A.
Figure 3C:
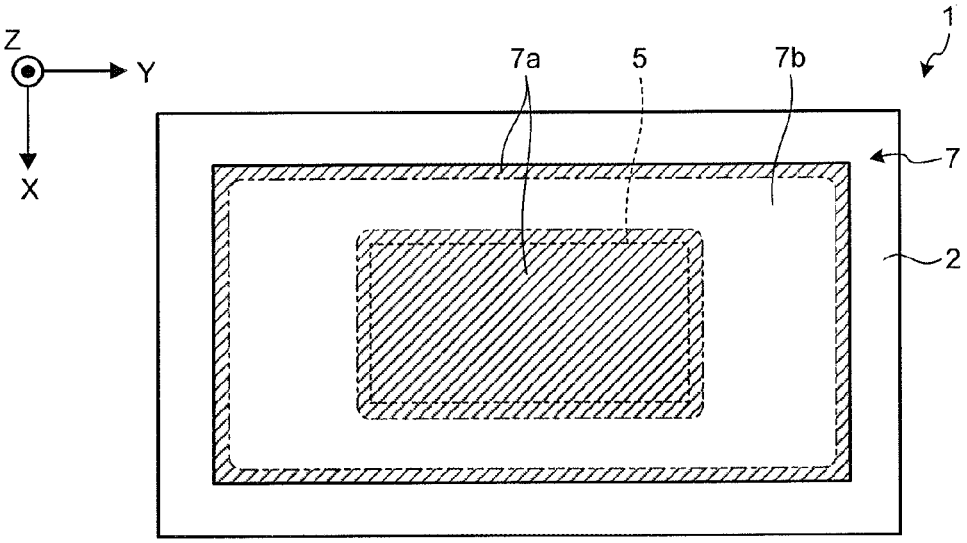
FIG. 3C is a schematic plane view illustrating a formed region of a protrusion part and a recessed part.

As illustrated in FIG. 3A, in the acoustic generator 1 according to the embodiment, irregularity is provided on a surface of a resin layer 7 daringly. The irregularity can be formed, for example, by omitting a shaping process of the resin layer 7, in which process a surface thereof is rubbed and cut at a position of the height of a frame body 2.

Here, as illustrated in FIG. 3A, a distance between the position of the height of the frame body 2 and a vibrating body 3*a* is assumed as a height h1 and a distance between the position of the height of the frame body 2 and a piezoelectric element 5 is assumed as a height h2. That is, the height h1>the height h2.

In such a case, when a solution to be a material of resin is poured in such a manner as to be lower than the height h1 to shape the resin layer 7 and before the resin layer 7 is cured, the solution to be a material of resin is added to a part corresponding to an upper part of the piezoelectric element 5 in such a manner that the part becomes protruded compared to the other region. Thus, on the surface of the resin layer 7, relative irregularity is formed between the part corresponding to the upper part of the piezoelectric element 5 and a part not corresponding to the upper part thereof.

That is, on the surface of the resin layer 7, a protrusion part is formed on the part corresponding to the upper part of the piezoelectric element 5 in such a manner as to cover the piezoelectric element 5 and a recessed part is formed on a part corresponding to a periphery of the piezoelectric element 5.

Also, as illustrated in FIG. 3B, in a boundary between the frame body 2 and the resin layer 7, the surface of the resin layer 7 slants and a meniscus m is formed. Thus, a relative protrusion part is formed along an inner periphery of the frame body 2.

A formed region in which the protrusion part 7*a* and the recessed part 7*b* are formed is illustrated in FIG. 3C. That is, as illustrated as a slash region shaded with a slash in FIG. 3C, at least one protrusion part 7*a* is formed in such a manner to cover a whole region which overlaps with the piezoelectric element 5 when the resin layer 7 is seen in a plane perspective. Also, the protrusion part 7*a* is formed in a region along the boundary with the frame body 2 when the resin layer 7 is seen in a planar view.

Also, in a region other than the slash region of the resin layer 7 in FIG. 3C, the recessed part 7*b* is formed. Note that in FIG. 3C, to make it easier to understand the description, the formed region of the protrusion part 7*a* and the recessed part 7*b* is distinctly zoned and illustrated but is not what defines an aspect of an actual formed region strictly.

In such a manner, by forming the irregularity on the surface of the resin layer 7, a symmetric property of a composite vibrating body in a thickness direction can be reduced and a resonance frequency can be made partially uneven. That is, a peak P of a sound pressure of a resonance point can be varied and a frequency characteristic of the sound pressure can be made flat. Thus, a frequency characteristic of a good sound pressure can be obtained.

Also, the protrusion part 7*a*, which is formed along the boundary between the resin layer 7 and the frame body 2 in a planer view, suppresses propagation of vibration around the frame body 2 which becomes a node of the vibration. Thus, a gap can be generated between an entering speed and a reflection speed of the vibration from the piezoelectric element 5.

Here, as illustrated in FIG. 3A to FIG. 3C, the protrusion part 7*a* is formed to the boundary between the resin layer 7 and the frame body 2 and a protrusion part is formed to the part corresponding to the upper part of the piezoelectric element 5 in such a manner as to cover the piezoelectric element 5. Thus, when the vibrating body 3*a* vibrates, amplitude of the protrusion part 7*a* becomes smaller than that of the recessed part 7*b* due to an influence of the thickness, and thus, a difference in the amplitude is generated between the protrusion part 7*a* and the recessed part 7*b* and a gap can be generated between the entering speed and the reflection speed of the vibration from the piezoelectric element 5.

Thus, this can also make the peak P of the sound pressure of the resonance point varied and can make the frequency characteristic of the sound pressure flat, and thus, a good frequency characteristic can be obtained.

Also, since the shaping process of the surface of the resin layer 7 can be omitted, a cost in mass production of the acoustic generator 1 can be reduced.

Figure 4A:
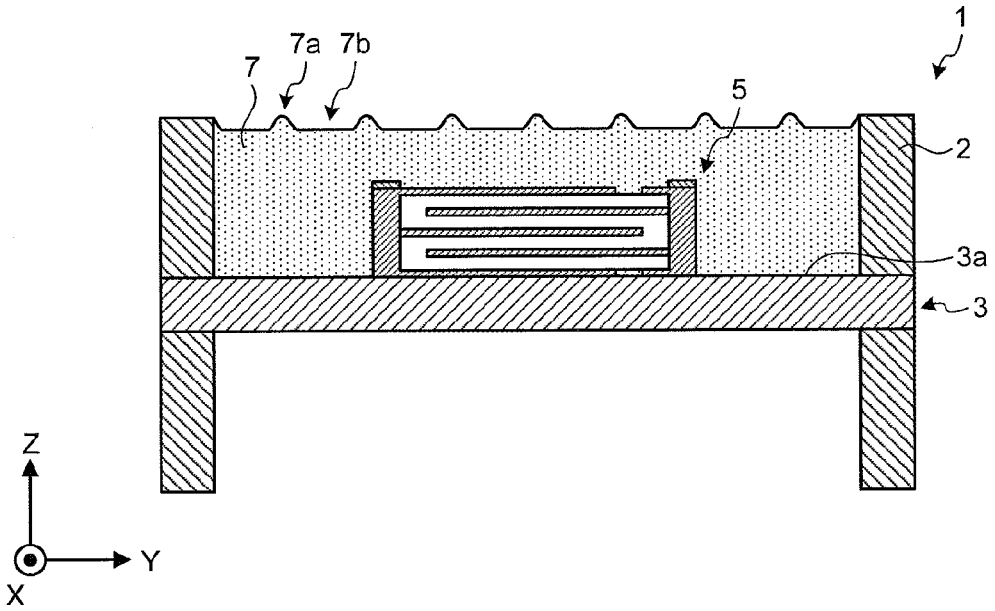
FIG. 4A is a first schematic sectional view illustrating a different forming example of a protrusion part and a recessed part.

Also, a plurality of protrusion parts 7*a* and recessed parts 7*b* may be provided on the surface of the resin layer 7 in a uniformly distributed manner. Such a case will be described with reference to FIG. 4A to FIG. 4C. FIG. 4A is a first schematic sectional view illustrating a different forming example of a protrusion part 7*a* and a recessed part 7*b*.

Figure 4B:
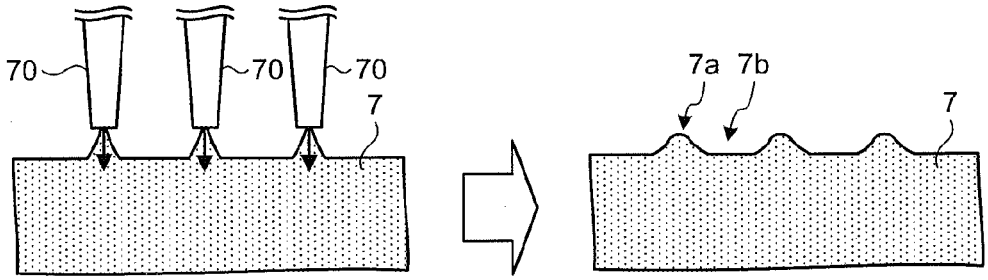
FIG. 4B is a first schematic view illustrating a different method for forming a protrusion part and a recessed part.
Figure 4C:
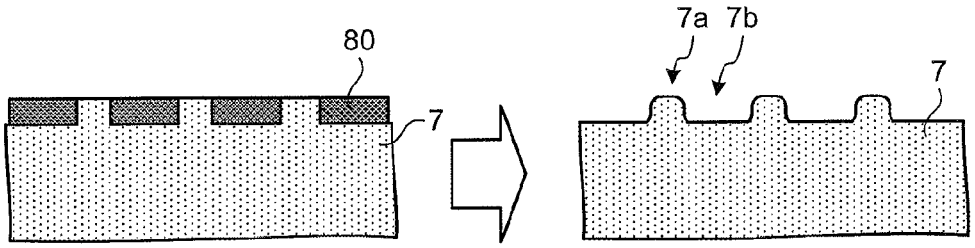
FIG. 4C is a second schematic view illustrating a different method for forming a protrusion part and a recessed part.

Also, FIG. 4B and FIG. 4C are first and second schematic views illustrating a different method for forming a protrusion part 7*a* and a recessed part 7*b*.

As illustrate in FIG. 4A, a plurality of protrusion parts 7*a* and recessed parts 7*b* may be provided on the surface of the resin layer 7 in a uniformly distributed manner. Even in such a case, on a boundary surface of the vibrating body 3*a* and the surface of the resin layer 7, the peak P of the sound pressure of the resonance point can be varied, and thus, the frequency characteristic of the sound pressure can be made flat. Thus, a frequency characteristic of a good sound pressure can be obtained.

Also, by distributing the plurality of protrusion parts 7*a* and recessed parts 7*b* on the surface of the resin layer 7, a surface area of the resin layer 7 can be increased. Thus, a propagation distance of sound on the surface of the resin layer 7 and a propagation distance on the boundary surface of the vibrating body 3*a* can be made different from each other. Thus, resonance can be made gentle, and the frequency characteristic of the sound pressure can be made flat and a frequency characteristic of a good sound pressure can be obtained.

Such protrusion parts 7*a* and recessed parts 7*b* can be formed, for example, by a method illustrated in FIG. 4B. For example, as illustrated in FIG. 4B, when the resin layer 7 is poured into the frame of the frame body 2, a forming material of the resin layer 7 is poured from a plurality of nozzles 70 provided in parallel.

In such a case, by making the forming material, which is discharged from the parallel nozzles 70, cure with a mark of the discharge being left daringly, protrusion parts 7*a* and recessed parts 7*b* illustrated on a right side in FIG. 4B can be formed on the surface of the resin layer 7. Here, in a case of the form illustrated in FIG. 4B, the height of each protrusion part 7*a* is, for example, 1 μm to 1 mm. When a region which is an origin of the protrusion is a circle, a diameter thereof is, for example, 10 μm to 20 mm.

Also, as illustrated in FIG. 4C, the protrusion parts 7*a* and the recessed parts 7*b* may be formed by a method of screen printing. That is, as illustrated in FIG. 4C, by daringly leaving a mesh mark of a screen plate 80 of the screen printing on the surface of the resin layer 7, protrusion parts 7*a* and recessed parts 7*b* illustrated on a right side in FIG. 4C can be obtained. Here, in a case of the form illustrated in FIG. 4C, the height of each protrusion part 7*a* is, for example, 1 μm to 100 μm, the width of each protrusion part 7*a* is, for example, 5 μm to 50 μm and the width of each recessed part 7*b* is, for example, 5 μm to 50 μm.

In a case of the method of the screen printing, a cost of mass production of the acoustic generator 1 can be also reduced.

Also, the plurality of protrusion parts 7*a* and recessed parts 7*b* illustrated in FIG. 4A to FIG. 4C may be provided in such a manner that larger number thereof are distributed on an upper part of the piezoelectric element 5. Such a case will be described with reference to FIG. 5A to FIG. 5C.

Figure 5A:
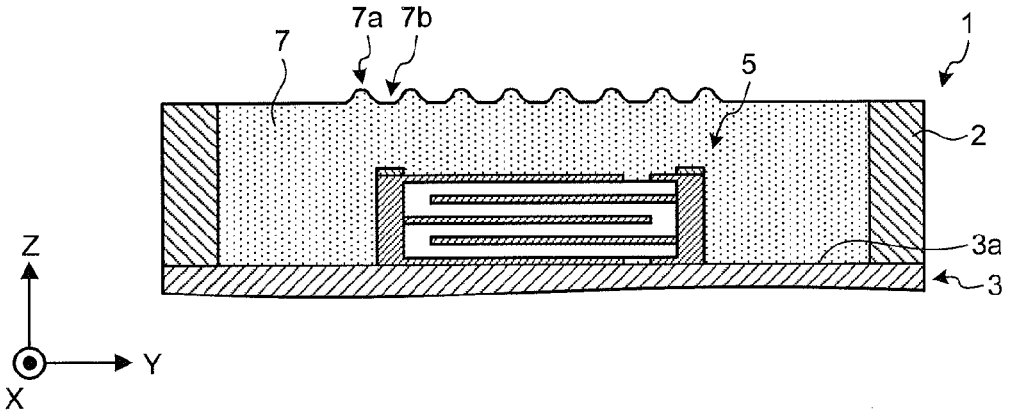
FIG. 5A is a second schematic sectional view illustrating a different forming example of a protrusion part and a recessed part.
Figure 5B:
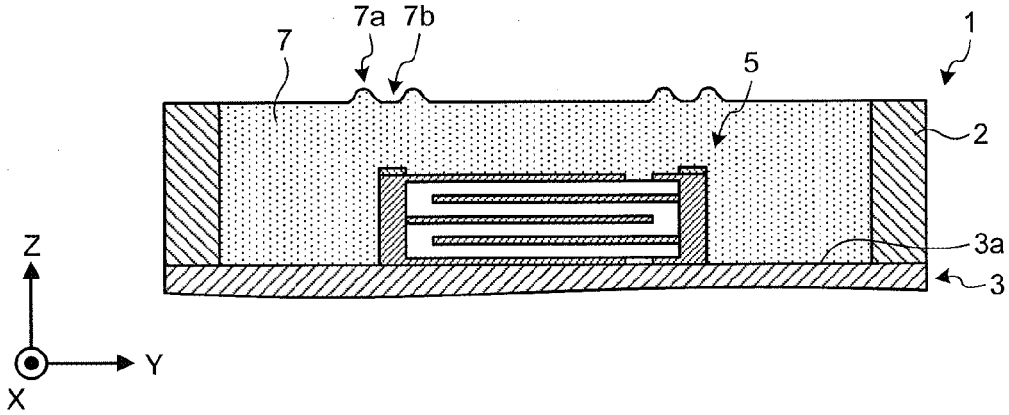
FIG. 5B is a third schematic sectional view illustrating a different forming example of a protrusion part and a recessed part.
Figure 5C:
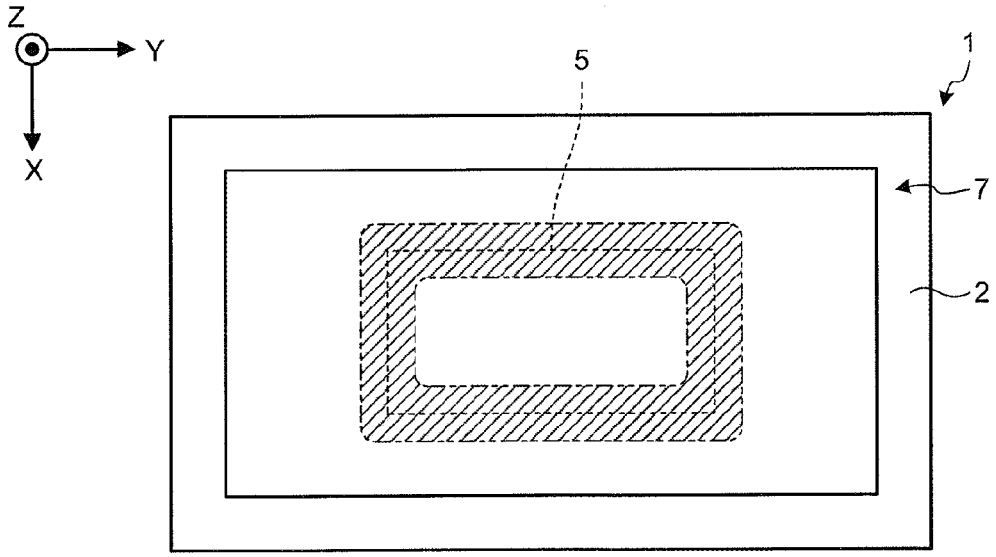
FIG. 5C is a schematic plane view illustrating a distribution region of the protrusion part and the recessed part illustrated in FIG. 5B.

FIG. 5A and FIG. 5B are second and third schematic sectional views illustrating a different forming example of a protrusion part 7*a* and a recessed part 7*b*. Also, FIG. 5C is a schematic plane view illustrating a distribution region of the protrusion part 7*a* and the recessed part 7*b* illustrated in FIG. 5B.

As illustrated in FIG. 5A, on the upper part of the piezoelectric element 5 in the resin layer 7, that is, on a region which overlaps with the piezoelectric element 5 when the resin layer 7 is seen in a plane perspective, the plurality of protrusion parts 7*a* and the recessed parts 7*b* may be provided and distributed.

Thus, since vibration of the piezoelectric element 5 which is a source of vibration can be suppressed by the protrusion parts 7*a*, the peak P of the sound pressure of the resonance point can be made gentle as getting closer to the piezoelectric element 5. That is, the peak P of the sound pressure of the resonance point can be varied and the frequency characteristic of the sound pressure can be made flat. Thus, a frequency characteristic of a good sound pressure can be obtained.

Also, as illustrated in FIG. 5B, a plurality of protrusion parts 7*a* and recessed parts 7*b* may be provided and distributed in a partial region along an outline of the piezoelectric element 5. Note that here, the partial region along the outline of the piezoelectric element 5 is a part surrounding the outline of the piezoelectric element 5 (part which strides outline) when the resin layer 7 is seen in a plane perspective, the part being illustrated as a slash region in FIG. 5C.

In such a case, propagation of vibration from the piezoelectric element 5 to a periphery can be suppressed by the protrusion parts 7*a*. Thus, the peak P of the sound pressure of the resonance point can be made gentle as getting closer to the piezoelectric element 5. That is, the peak P of the sound pressure of the resonance point can be varied and the frequency characteristic of the sound pressure can be made flat. Thus, a frequency characteristic of a good sound pressure can be obtained.

Figure 6:
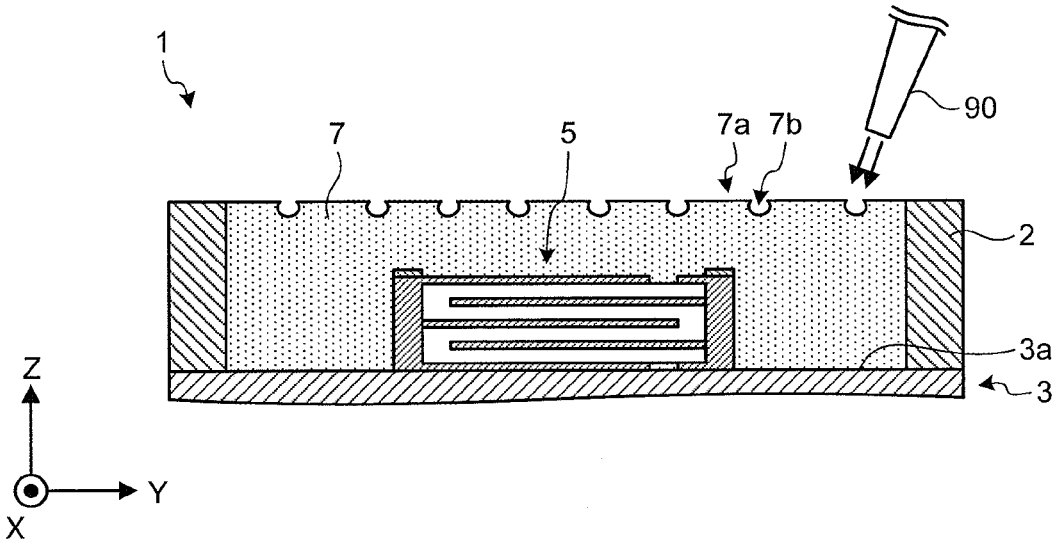
FIG. 6 is a fourth schematic sectional view illustrating a different forming example of a protrusion part and a recessed part.

Next, FIG. 6 is a fourth schematic sectional view illustrating a different forming example of a protrusion part 7*a* and a recessed part 7*b*.

As illustrated in FIG. 6, the protrusion part 7*a* and the recessed part 7*b* may be provided by forming the recessed part 7*b* as an open pore opened to the surface of the resin layer 7. In such a case, the recessed part 7*b* can be formed, for example, by a so-called shot-blasting method in which a polishing material such as sand, or dry ice is sprayed as a blasting material from a nozzle 90.

Here, when an opening part of the recessed part 7*b* is a circle, a diameter thereof is, for example, 10 μm to 10 mm, and a depth thereof is 1 μm to 50 μm.

In such a manner, also by providing the recessed part 7*b* as an open pore opened to a surface of the resin layer 7, the protrusion part 7*a* and the recessed part 7*b* can be formed. Thus, the peak P of the sound pressure of the resonance point is varied and a frequency characteristic of the sound pressure can be made flat. Thus, a frequency characteristic of a good sound pressure can be obtained.

Figure 7A:
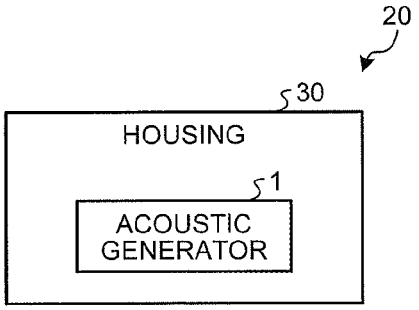
FIG. 7A is a view illustrating a configuration of an acoustic generation device according to the embodiment.
Figure 7B:
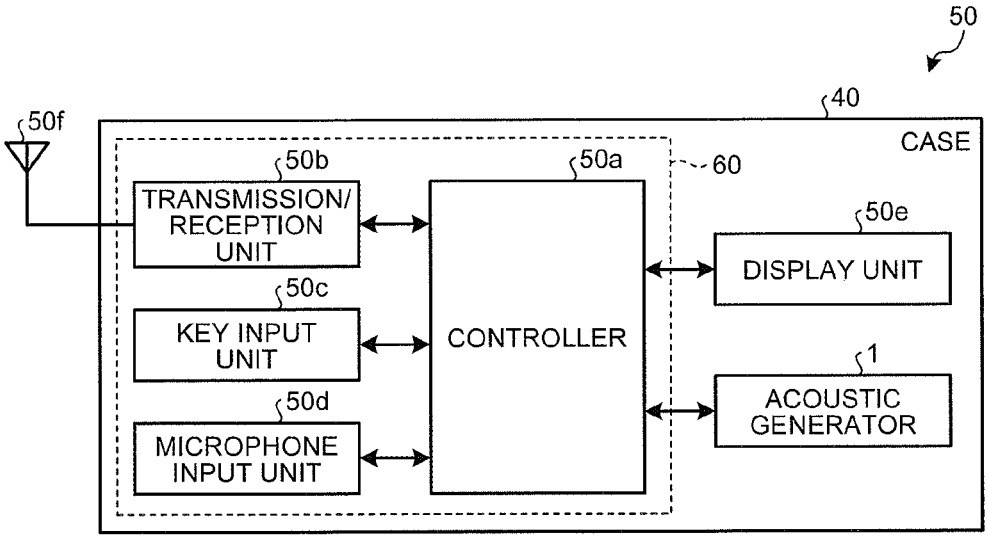
FIG. 7B is a view illustrating a configuration of an electronic device according to the embodiment.

Next, an acoustic generation device and an electronic device to which the acoustic generator 1 according to the embodiment described above will be described with reference to FIG. 7A and FIG. 7B. FIG. 7A is a view illustrating a configuration of an acoustic generation device 20 according to the embodiment. FIG. 7B is a view illustrating a configuration of the electronic device 50 according to the embodiment. Note that in both drawings, only a configuration element necessary for description is illustrated and a general configuration element is not illustrated.

The acoustic generation device 20 is an acoustic generation device such as a so-called speaker. As illustrated in FIG. 7A, for example, the acoustic generation device 20 includes the acoustic generator 1 and a housing 30 to house the acoustic generator 1. The housing 30 resonates sound, which is generated by the acoustic generator 1, in the inside and emits the sound, to the outside, from an opening (not illustrated) formed on the housing 30. Since such a housing 30 is included, for example, a sound pressure in a low frequency band can be increased.

Also, the acoustic generator 1 can be mounted to various electronic devices 50. For example, in FIG. 7B in the following, it is assumed that the electronic device 50 is a mobile terminal apparatus such as a mobile phone or a tablet terminal.

As illustrated in FIG. 7B, the electronic device 50 includes an electronic circuit 60. The electronic circuit 60 includes, for example, a controller 50*a*, a transmission/reception unit 50*b*, a key input unit 50*c*, and a microphone input unit 50*d*. The electronic circuit 60 is connected to the acoustic generator 1 and includes a function to output a sound signal to the acoustic generator 1. The acoustic generator 1 generates sound based on the sound signal input from the electronic circuit 60.

Also, the electronic device 50 includes a display unit 50*e*, an antenna 50*f*, and the acoustic generator 1. Also, the electronic device 50 includes a case 40 to house these devices.

Note that in FIG. 7B, a state in which all the devices, including the controller 50*a*, are housed in one case 40 is illustrated but is not a limitation of a housed state of the devices. In the present embodiment, at least the electronic circuit 60 and the acoustic generator 1 need to be housed in one case 40.

The controller 50*a* is a control unit of the electronic device 50. The transmission/reception unit 50*b* transmits/receives data through the antenna 50*f* based on control by the controller 50*a*.

The key input unit 50*c* is an input device of the electronic device 50 and receives a key input operation by an operator. The microphone input unit 50*d* is also an input device of the electronic device 50 and receives a voice input operation or the like by an operator.

The display unit 50*e* is a display output device of the electronic device 50 and outputs display information based on the control by the controller 50*a*.

Then, the acoustic generator 1 operates as a sound output device in the electronic device 50. Note that the acoustic generator 1 is connected to the controller 50*a* of the electronic circuit 60 and generates sound when voltage controlled by the controller 50*a* is applied.

Incidentally, in FIG. 7B, the description has been made on the assumption that the electronic device 50 is a mobile terminal apparatus. However, a type of the electronic device 50 is not a matter and application to various consumer devices including a sounding function is possible. For example, application is possible not only to a thin television or a car audio device but also to various products, which include a sounding function such as "speaking", such as a vacuum cleaner, a laundry machine, a refrigerator, and a microwave.

As described, the acoustic generator according to the embodiment includes an exciter (piezoelectric element), a flat vibrating body, and a resin layer. When an electric signal is input, the exciter vibrates. To the vibrating body, the exciter is attached. Due to the vibration of the exciter, the vibrating body vibrates with the exciter. The resin layer is arranged to cover surfaces of the exciter and the vibrating body to which the exciter is attached. Thus, the resin layer is integrated with the vibrating body and the exciter. Also, to the resin layer, irregularity is provided.

Thus, according to the acoustic generator of the embodiment, a frequency characteristic of a good sound pressure can be obtained.

Note that in the above described embodiment, a case where a piezoelectric element is provided to one principal surface of a vibrating body has been described as an example but is not a limitation. The piezoelectric element may be provided to both surfaces of the vibrating body.

Also, in the above described embodiment, a case where a shape of a region inside a frame body is substantially rectangular has been described as an example and it has been described that the shape only needs to be a polygon. However, the case is not a limitation. The shape may be a circle or an ellipse.

Also, in the above described embodiment, a case where a vibration plate includes a thin film such as a resin film has been described as an example, but is not a limitation. For example, the vibration plate may include a tabular member.

Also, in the above described embodiment, a case where a support member to support a vibrating body is a frame body and where a peripheral edge of the vibrating body is supported has been described as an example, but is not a limitation. For example, only both ends in a longitudinal direction or a short-side direction of the vibrating body may be supported.

Also, in the above described embodiment, a case where an exciter is a piezoelectric element has been described as an example. However, the exciter is not limited to the piezoelectric element as long as a function to vibrate when an electric signal is input is included.

For example, an electrodynamic exciter, an electrostatic exciter, or an electromagnetic exciter which is known widely as an exciter to vibrate a speaker may be used.

Note that the electrodynamic exciter vibrates a coil arranged in a magnetic pole of a permanent magnet by applying current to the coil. Also, the electrostatic exciter vibrates two metallic plates facing each other by applying bias and an electric signal to the metallic plates, and the electromagnetic exciter vibrates a thin iron plate by applying an electric signal to a coil.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

The invention claimed is:

1. An acoustic generator comprising:

an exciter configured to vibrate when an electric signal is input;

a flat vibrating body to which the exciter is attached and which is configured to vibrate with the exciter due to the vibration of the exciter; and a resin layer which is arranged to cover surfaces of the exciter and the vibrating body, to which the exciter is attached, and is integrated with the vibrating body and the exciter, wherein irregularity is provided on a surface of the resin layer, and the irregularity includes, when the resin layer is seen in a plane perspective, first protrusion parts and first recessed parts provided on a region which overlaps with the exciter and second protrusion parts and second recessed parts provided on a region which does not overlap with the exciter.

2. The acoustic generator according to claim 1, wherein the first protrusion and recessed parts and the second protrusion and recessed parts of the irregularity are provided in such a manner that the protrusion and recessed parts are uniformly distributed on the surface of the resin layer.

3. The acoustic generator according to claim 1, wherein at least one of the recessed parts of the irregularity are provided as open pores opened to the surface of the resin layer.

4. The acoustic generator according to claim 1, wherein the exciter is a bimorph-type laminated piezoelectric element.

5. An acoustic generation device comprising:

the acoustic generator according to claim 1; and a housing configured to house the acoustic generator.

6. An electronic device comprising:

the acoustic generator according to claim 1;

an electronic circuit connected to the acoustic generator; and a case configured to house the electronic circuit and the acoustic generator, wherein the electronic device has a function of generating sound from the acoustic generator.

* * * * *